US008739452B1

(12) United States Patent
Calvert

(10) Patent No.: US 8,739,452 B1
(45) Date of Patent: Jun. 3, 2014

(54) SECONDARY GUN PIVOT PISTOL

(71) Applicant: SGPP Associates, Trustee for Secondary Gun Pivot Pistol CRT Trust, Manassas, VA (US)

(72) Inventor: S. Mill Calvert, Manassas, VA (US)

(73) Assignee: SGPP Associates, Trustee for Secondary Gun Pivot Pistol CRT Trust, Manassas, VA (US)

( * ) Notice: Subject to any disclaimer, the term of this patent is extended or adjusted under 35 U.S.C. 154(b) by 0 days.

(21) Appl. No.: 14/102,941

(22) Filed: Dec. 11, 2013

(51) Int. Cl.
*F41C 27/00* (2006.01)

(52) U.S. Cl.
CPC ..... *F41C 27/00* (2013.01)
USPC ..... 42/90; 42/106; 89/37.04

(58) Field of Classification Search
CPC ..... F41C 23/12; F41C 23/16; F41C 27/00; F41G 11/003; F41A 35/00; F41A 27/00; F41A 27/06; F41A 27/14
USPC ..... 42/72, 90, 105, 106; 89/37.01, 37.04
See application file for complete search history.

(56) References Cited

U.S. PATENT DOCUMENTS

| | | | | |
|---|---|---|---|---|
| 511,940 | A * | 1/1894 | Fairbanks | 42/106 |
| 839,978 | A * | 1/1907 | Adrianson | 42/106 |
| 2,075,704 | A * | 3/1937 | Crosby | 42/106 |
| 6,843,015 | B2 | 1/2005 | Sharp | |
| 6,920,713 | B1 * | 7/2005 | Love | 42/94 |
| 7,614,805 | B2 | 11/2009 | Showalter | |
| 8,209,897 | B2 * | 7/2012 | Schneider et al. | 42/105 |
| 8,281,512 | B2 * | 10/2012 | Lara | 42/85 |
| 8,297,605 | B2 | 10/2012 | Lee et al. | |
| 8,371,056 | B1 | 2/2013 | Baker et al. | |
| 2005/0188593 | A1 * | 9/2005 | Cerovic et al. | 42/77 |
| 2005/0188827 | A1 * | 9/2005 | McNulty, Jr. | 89/1.11 |
| 2009/0313873 | A1 * | 12/2009 | Roth | 42/72 |
| 2011/0099877 | A1 | 5/2011 | Sandler | |
| 2011/0225865 | A1 * | 9/2011 | Williams | 42/90 |
| 2012/0167437 | A1 * | 7/2012 | Holmberg | 42/90 |
| 2013/0239453 | A1 * | 9/2013 | Trimble | 42/106 |

* cited by examiner

*Primary Examiner* — Michael Carone
*Assistant Examiner* — Joshua Freeman
(74) *Attorney, Agent, or Firm* — Louis Ventre, Jr.

(57) ABSTRACT

A weapon system includes a long gun, such as a rifle or a shotgun, a handgun, and a bracket secured to the rifle or shotgun around the barrel. The bracket permits swiveling and firing the handgun while attached to the long gun. The bracket includes a swivel ball joint below the long-gun barrel and an attachment brace that releasably connects the swivel ball joint and the handgun. The handgun may be a semi-automatic pistol where a slide moves back and forth when fired. The attachment brace has a top section and a bottom section. The top section goes around the slide so that it does not interfere with its movement. The bottom section contacts the handgun below the slide to securely attach the handgun to the rifle or shotgun.

4 Claims, 2 Drawing Sheets

SECONDARY GUN PIVOT PISTOL

TECHNICAL FIELD

In the field of firearms, a portable weapon system for close combat involves a shotgun or a rifle with an attached pivotable handgun. The pivotable handgun serves as a hand grip for the shotgun or rifle as well as an independently aim-able and discharge-able weapon.

BACKGROUND ART

Law enforcement and crime fighting often involve armed conflict within close quarters of a house, apartment complex, warehouse or other building where the line of sight is often less than tens of feet and the potential for multiple opponents to attack from a concealed position may be high.

Police also may confront felons incident to riots and other violent crimes where a riot gun is used to discourage resistance and offer less-than-lethal stopping force for use by the police officer. The riot gun is often used as a less-lethal weapon and can be standard firearms, usually shotguns and grenade launchers, adapted to riot control use with appropriate ammunition.

More and more, military forces are required to engage an enemy in an urban environment where a long gun, a rifle or shotgun, is the weapon of choice facing possible multiple hostiles armed with guns and other hand-held weapons such as swords, knives, axes, or tools.

Present technology discloses means for attaching accessories to a rifle in a fixed position and orientation, such as facing forward along the barrel line of sight. Laser sights and scopes are the most common attachment. A handgun may be attached using such accessorizing technology, and if so attached would invariably require detaching it from the rifle before aiming and discharging at a target.

SUMMARY OF INVENTION

A weapon system includes a long gun, such as a rifle or a shotgun, a handgun, and a bracket secured to the rifle or shotgun around the barrel. The bracket permits swiveling and firing the handgun while attached to the long gun. The bracket includes a swivel ball joint below the long-gun barrel and an attachment brace that releasably connects the swivel ball joint and the handgun. The handgun may be a semi-automatic pistol where a slide moves back and forth when fired. The attachment brace has a top section and a bottom section. The top section goes around the slide so that it does not interfere with its movement. The bottom section contacts the handgun below the slide to securely attach the handgun to the rifle or shotgun. A finger-operable set screw can be tightened in the swivel ball joint to add frictional resistance to its rotation. Optionally, a telescoping rod connects the swivel ball joint to the attachment brace so as to enable extending the handgun downward for enhanced swiveling capability.

Technical Problem

No combination weapon system is currently available to permit primary use of a long gun while having instantaneous availability of a handgun that while still attached to the long gun, can be pivoted in three degrees of freedom and discharged at a hostile that would otherwise require precious time to swing and re-aim the long gun.

There is no hand-carried weapon system available today that combines a riot gun with a standard handgun so that the police officer has an immediately available and pivotable handgun for simultaneous use when holding and using a less than lethal riot gun.

When using a long gun, two hands are typically required. If a soldier is using a rifle, then effectively he must stop that use and un-holster a pistol in order to use the pistol. Shooting both at the same time is a practical impossibility. Carrying a rifle or shotgun effectively means that the long gun is the only means to confront hostile action. When confronted with multiple hostiles in different lines of sight, there is no practical weapon combination that permits shooting the rifle in one direction and also shooting the handgun in another. While a soldier may carry a handgun with his M16 rifle, in all practical engagements, he uses either the rifle or the handgun, but not both at the same time.

In the War on Terror and other law enforcement situations, many times our brave soldiers or police officers find themselves in dangerous close combat situations as they go room to room through a building and have blind corners to go around without knowing what danger lies ahead. If they turn a corner and there is one armed terrorist, they have a good chance of getting off a shot with their rifle pointing at the terrorist. If the soldier turns a blind corner and there is one terrorist straight ahead and another terrorist is in another side of the room, this brave soldier will be shot dead because he can only point his rifle or shotgun in one direction at one time. In the split second of time that separates life and death, he can only shoot at one terrorist while the other one shoots him. If only there was a way to have an assault rifle or shotgun that could accurately shoot in two different directions at the very same time. A gun such as this would save many of our brave soldiers and police who protect us and many of our freedoms.

Means for attaching accessories to a rifle may permit a handgun to be attached to a rifle, but present art teaches no means or mechanism to permit pivoting of the handgun while it is attached to the rifle for instantaneously and simultaneously aiming and shooting at two different targets in two different lines of sight. Such accessorizing systems would also require modifying the handgun with, for example, a rail system and thus be useful for only specially adapted handguns.

Solution to Problem

The solution is a weapon system combining a long gun, such as an assault rifle or shotgun, which can accurately shoot in two different directions at one time. If the pistol has a laser targeting pointer installed, it would be a simple matter for a soldier to have his rifle aimed straight ahead at a terrorist, and out of his peripheral field of vision, he can easily pivot the combination weapon system to laser target a second terrorist. He can then simultaneously fire two shots at the same time and shoot both terrorists before they shoot him.

Many assault rifles have a front pistol grip that is located below the barrel of the rifle. What is needed is a fixed pistol grip formed by a fully functional and pivotable pistol as the new grip. The solution enables the handgun to be fired and reloaded without any interference with the mechanical processes involved in firing and loading the pistol or in firing and loading the long gun. The solution also enables the pistol to be held in a steady position when desired or easily pivoted in three degrees of freedom, and then held steady to fire a shot.

The solution is a combination weapon system that is versatile in that it will enable attachment of a wide variety of handguns without a need for structurally accessorizing the handgun, such as, for example, with a rail system. The solution disclosed herein requires no structural changes to the handgun.

Advantageous Effects of Invention

Disclosed is a combination of two weapons structurally tied together to uniquely form an assault weapon having greater functionality than the individual weapons. The greater functionality is due to the creation of a possible simultaneous operation of both weapons, where otherwise this would be physically impractical, if not impossible.

A unique architecture and engineering structure of the combination weapon system enables the pistol to be fired and reloaded without in anyway interfering with the mechanical processes of the pistol or the long gun. It also enables the pistol to easily be pivoted in many different directions, even if the secondary target is much higher up than the height of the rifle barrel.

The combination weapon system enables the pistol to be held steady and aimed at a secondary target while the rifle barrel is aimed at the primary target. It enables the soldier to accurately aim and take two shots at the same time. It can also save the soldier's life when he has emptied the clip on his assault rifle and has no time to reload before he is shot. He now has a full clip on the pistol to shoot with.

The combination weapon system enables the pistol to be held steady and aimed at a secondary target while the rifle barrel does not in any way interfere with the ejection of a spent casing from a semi-auto. It does not interfere with loading new bullets or inserting a new magazine into the pistol.

The combination weapon system enables the pistol to be held steady and aimed at a secondary target while the rifle barrel is designed to accommodate a large variety of different styles of pistols, such as revolvers and semi-automatic pistols. It is made to be readily installed or taken off of the rifle, with no needed tools, in a matter of seconds.

Because of the disclosed combination weapon system, many of our brave soldiers and law enforcement personnel will no longer have to give up their lives in order to protect ours. The combination weapon system provides a long-gun backup and simultaneous discharge-able weapon that ensures that our bravest and finest come home.

BRIEF DESCRIPTION OF DRAWINGS

The drawings illustrate preferred embodiments of the secondary gun pivot pistol according to the disclosure. The reference numbers in the drawings are used consistently throughout. New reference numbers in FIG. 2 are given the 200 series numbers.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
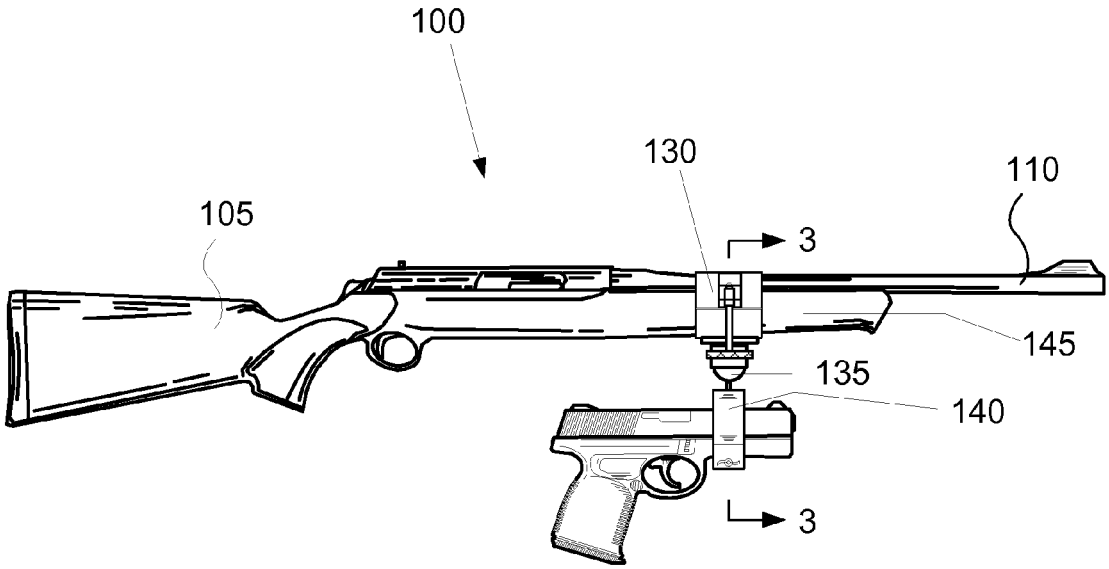
FIG. 1 is a side elevation view illustrating the weapons system with a long gun, handgun and bracket.

FIG. 1 is a side elevation view illustrating the weapons system (100) with a long gun (105), handgun (205) and bracket (130).

The term "long gun" is used herein to signify a rifle, a shotgun, and any small arm designed to be carried by a person while providing the shooter with the ability to hold the firearm more steadily than a handgun. The long gun (105) has a long-gun barrel (110). Typically, the long gun has a front grip (145) around at least a portion of the barrel forward of the trigger and shoulder stock, which provide the user the ability to hold the firearm more steadily than a handgun. The shoulder stock also enables the long gun to be braced against the shooter's shoulder or hip.

Figure 2:
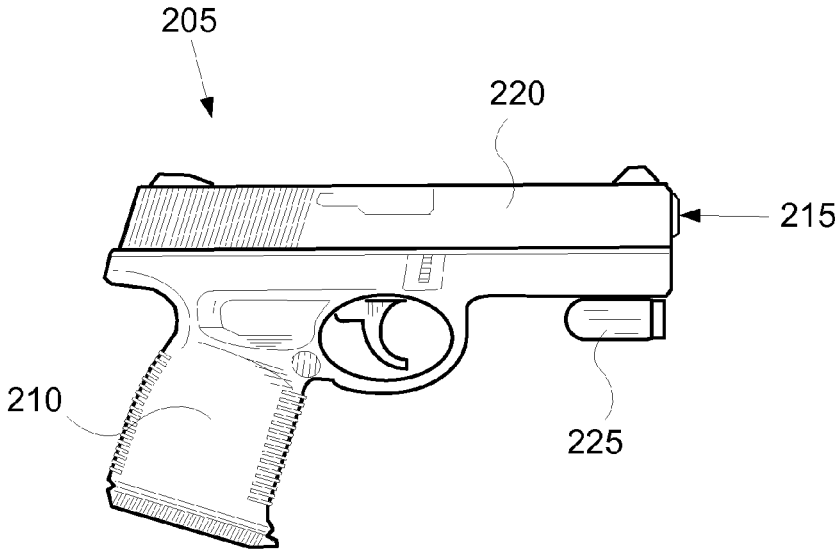
FIG. 2 is a side elevation view of a handgun.

FIG. 2 is a side elevation view of the handgun (205), which in this example is a semi-automatic pistol. The handgun (205) may be a revolver. The handgun (205) has a pistol grip (210), which is intended to be held in the shooter's hand. The handgun (205) has a muzzle (215), which is the open end of the hand-gun barrel where the bullet exits the handgun (205). The handgun (205) may be equipped with a laser targeting pointer (225). When the handgun (205) is a semi-automatic, as illustrated in the drawings, it will typically have a slide (220). The slide (220) uses blowback, which upon firing the cartridge, causes the slide (220) to move backwards toward the shooter. A spring usually returns the slide (220) to the starting position while chambering a new cartridge from the magazine. Typically, the slide (220) also functions to eject the spent casing and cock the hammer for a follow-on shot. When the handgun (205) is a revolver, it will typically include a cylinder containing multiple chambers and at least one barrel for firing. Typically, the cylinder revolves about an axis parallel to the barrel axis to align a chamber with the barrel for firing.

The bracket (130) is the structure that combines the long gun (105) and the handgun (205). The bracket (130) secured to the long gun (105) around the long-gun barrel (110) and also the front grip (145) on the long gun (105), when the front grip (145) is present at the securing point. Preferably, the part of the bracket (130) around the long-gun barrel (110) and front grip (145) is a strap or is strap-like in function so as to tightly conform to the perimeter of the long-gun barrel (110) and front grip (145), when the front grip (145) is present. A screw/band hose clamp is an example and preferably one that is finger operable with a butterfly nut or a large knurled end disc for tightening without tools. Securing the bracket (130) to the long gun (105) fixes the bracket (130) in place on the long gun (105).

The bracket (130) includes a swivel ball joint (135) below the long-gun barrel (110). The swivel ball joint (135) where the ball within the swivel ball joint (135) can be pivoted and rotated. A finger-operable set screw (315) may be included that when tightened engages the swivel ball joint (135) to add frictional resistance to rotation of the swivel ball joint (135). The finger-operable set screw (315) may be used to fix the position of the ball in the swivel ball joint (135), virtually preventing rotation.

The bracket (130) further includes attachment brace (140) that releasably connects the swivel ball joint (135) and the handgun (205). Preferably, the ball within the swivel ball joint (135) is attached to a rod (325), shown in FIG. 3. The rod (325) connects two sections of the attachment brace (140) used for mounting the handgun (205). The rod (325) may be a telescoping rod (425), as shown in FIG. 4, having one section slidably inserted into a second section. Alternatively, the telescoping rod (425) may be extendable by unscrewing the rod sections. A set screw may lock the rod sections at the desired rod length.

Figure 3:
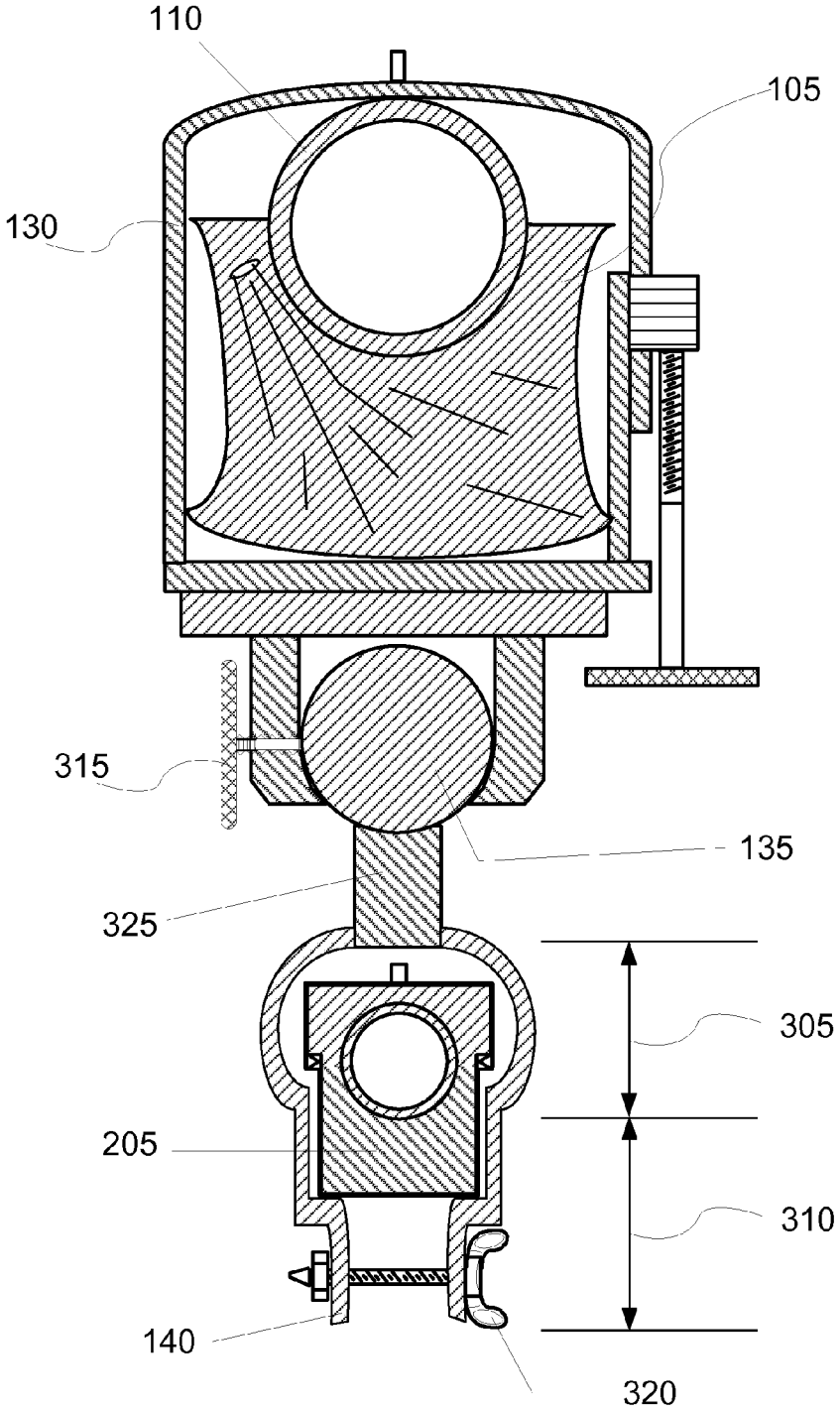
FIG. 3 is a sectional view taken along viewing lines 3-3 in FIG. 1, illustrating the assembled rifle, handgun, and bracket.
Figure 4:
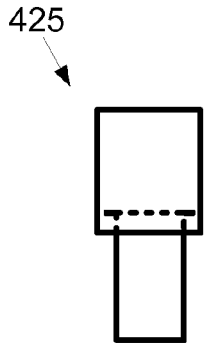
FIG. 4 is a front view of telescoping rod used to connect a swivel ball joint and attachment brace in the bracket.

The assembled long gun (105), handgun (205), and bracket (130) are illustrated in cross section in FIG. 3, which is the sectional view taken along viewing lines 3-3 in FIG. 1.

The two sections of the attachment brace (140) are a top section (305) and a bottom section (310). The top section (305) does not touch or engage the handgun (205) but rather is structured to go around the slide (220) without contacting it so as to permit unimpeded movement of the slide (220) when the handgun (205) is fired. When the handgun (205) is a revolver the top section (305) is structured to avoid the revolving cylinder. Thus, the top section (305) is not in direct physical contact the handgun (205).

The bottom section (310) is structured to be tighten-able against the part of the handgun below the slide (220) that does not move when the handgun (205) is fired. The bottom section (310) is structured to engage and contact the handgun (205) below the slide (220) so that the part of the handgun (205) that does not move when the handgun (205) is fired is tighten-able against the bottom section (310). When the handgun (205) is a revolver the bottom section (310) is structured to engage the handgun (205) below or in front of the cylinder on the frame. Preferably, the bottom section (310) is tightened using a nut and bolt to draw the bottom section (310) together and tightly engage the handgun (205). Preferably the bolt or nut is structured for finger operation, such as by having a thumb screw (320) or a large knurled disc so that the handgun (205) can be attached and removed from the bracket (130) by hand and without tools.

Thus, the attachment brace (140) is tighten-able to the handgun (205) such that the muzzle (215) of the handgun (205) can be adjusted to a rotatable position in three dimensions: up, down and sideways. The two sections of the attachment brace (140) enable the handgun (205) to be fired when the muzzle (215) is adjusted to the rotatable position while the handgun (205) is secured within the attachment brace (140) and is connected to the swivel ball joint (135).

EXAMPLE 1

The secondary gun pivot pistol installs onto an assault rifle using a bracket. The bracket includes a hose-clamp style strap that goes around the barrel or front-grip area of the rifle. The strap is then tightened down with a thumb screw. Below the strap, the bracket has a pivot ball joint that gives a great ability to point the pistol in many directions. Some versions of the bracket have two pivot ball joints connected by a rod therebetween for more movement flexibility. Below the ball joint is a rod extends downward to provide sufficient clearance to maneuver a pistol clamped in the bracket. This rod has a fixed length, but may be adjustable by being able to telescope or adjust in length. An attachment brace extends from the rod to mount the pistol. The attachment brace is tightened against the pistol with a thumb screw. The attachment brace comes in different configurations based on what type of pistol is being used. As examples, using a standard type revolver, the attachment brace fits around the gun's barrel and tightens up; and using a standard style 1911 semi-auto, the mounting support clamp tightens around the frame of the gun below the slide. For the semi-auto, there is sufficient clearance so the movement of the slide is not hampered in any way.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A weapon system comprising:

a long gun, the long gun comprising a long-gun barrel;

a handgun, the handgun comprising a pistol grip and a muzzle; and a bracket secured to the long gun around the barrel, the bracket comprising:

a swivel ball joint below the long-gun barrel; and an attachment brace releasably connecting the swivel ball joint and the handgun, the attachment brace tighten-able to the handgun such that the muzzle of the handgun is configured to be adjusted to a rotatable position in three dimensions, and such that the handgun can be fired when in such rotatable position while connected to the swivel ball joint.

2. The weapon system of claim 1, wherein the handgun is a semi-automatic pistol; wherein the handgun further comprises a slide; wherein the attachment brace is constructed with a top section and a bottom section; wherein the bottom section contacts the handgun below the slide; and wherein the top section is not in contact with the handgun and permits unimpeded movement of the slide.

3. The weapon system of claim 1, further comprising a finger-operable set screw that when tightened engages the swivel ball joint to add frictional resistance to rotation of the swivel ball joint.

4. The weapon system of claim 1, further comprising a telescoping rod connecting the swivel ball joint to the attachment brace.

* * * * *